United States Patent [19]

Rousselot

[11] Patent Number: 4,825,593

[45] Date of Patent: May 2, 1989

[54] DEVICE FOR ACTUATING A TIP-UP OR SECTIONAL DOOR

[75] Inventor: André J. Rousselot, Cluses, France

[73] Assignee: Somfy, France

[21] Appl. No.: 9,801

[22] Filed: Feb. 2, 1987

[30] Foreign Application Priority Data

Feb. 28, 1986 [FR] France ..... 86 02843

[51] Int. Cl.[4] ..... E05F 15/00

[52] U.S. Cl. ..... 49/199; 160/188; 16/94 R; 248/73; 248/231.91; 403/352

[58] Field of Search ..... 49/28, 199, 324, 360, 49/362; 160/188; 211/105.1, 105.2, 113; 16/94 R; 248/73, 231.9, 231.91, 251, 342; 403/352, 358

[56] References Cited

U.S. PATENT DOCUMENTS

| | | | |
|---|---|---|---|
| 1,229,874 | 6/1917 | Boye | 211/105.2 |
| 3,204,170 | 8/1965 | Monks | 49/28 |
| 4,018,005 | 4/1977 | Harris | 49/199 |
| 4,231,191 | 11/1980 | Ellmore | 49/28 |
| 4,311,225 | 1/1982 | Tsubaki et al. | 49/199 |

*Primary Examiner*—Kenneth J. Dorner
*Assistant Examiner*—Gerald A. Anderson
*Attorney, Agent, or Firm*—Kane, Dalsimer, Sullivan, Kurucz, Levy, Eisele and Richard

[57] ABSTRACT

This device for actuating a tip-up or sectional door comprises an elongated frame structure supporting a linearly movable member driven through a worm screw or a chain connected to the door to be driven, and secured at two upper points of which one is located at one end of the frame structure. This one end is secured to a fixed support formed with a vertical notch of which the bottom edge has a groove formed therein, the upper edge of this notch being limited by a surface located at a predetermined distance from the groove bottom. The frame structure comprises a support surface, for example in the form of a pin, and a locking surface, for example in the form of another pin, located at a distance from the first pin which corresponds to the predetermined distance. This frame structure can be fitted by a single person by anchoring the lower pin of the support and then raising the frame structure to a substantially horizontal position, so as to lock automatically the device in its operative position.

5 Claims, 1 Drawing Sheet

Fig. 1
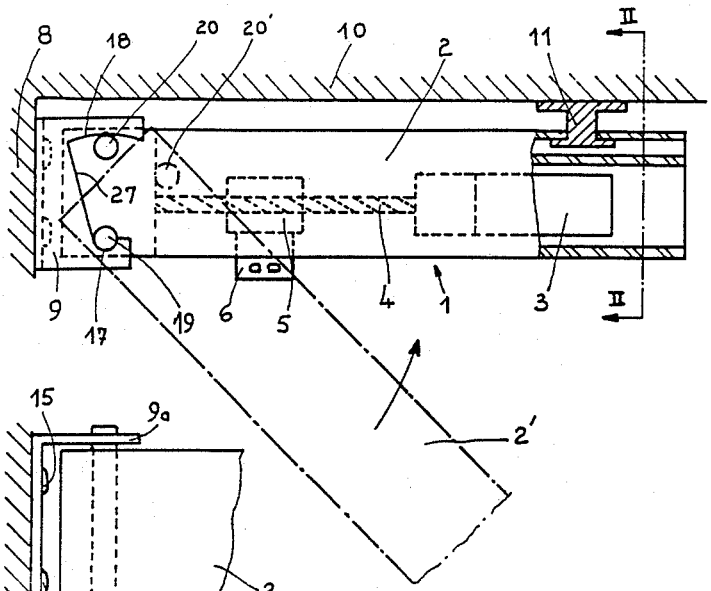
Fig. 2
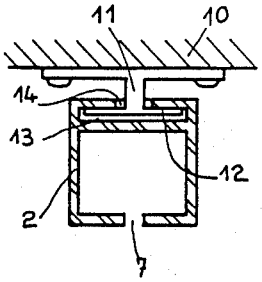
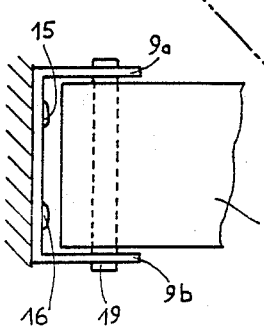
Fig. 3
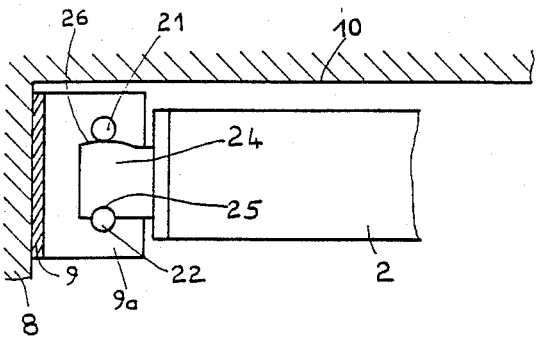
Fig. 4
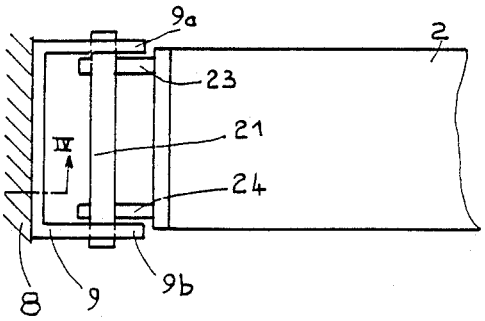
Fig. 5

DEVICE FOR ACTUATING A TIP-UP OR SECTIONAL DOOR

FIELD OF THE INVENTION

The present invention relates in general to means for actuating a tip-up or sectional door, of the type comprising an elongated tip-up frame and means for securing this frame at two upper points, at least one point being located at one end of the frame.

THE PRIOR ART

A linear actuating mechanism of this type, also referred to as an 'operator', is generally relatively long, about ten feet for mechanisms associated with relatively small standard tip-up doors. The weight of this mechanism, generally of the order of 33 pounds, is concentrated mainly in the end casing enclosing the motor and reduction gear unit driving a screw or a chain and a movable member driven by said screw or chain and coupled to the door to be actuated. For these various reasons, and also on account of their specific nature, devices of this type are difficult to handle.

Two families of devices of this character are known in the field. Firstly, the devices disclosed in patents DE-No. 29 14 572, BE-No. 811,708, FR-No. 512 485 and U.S. Pat. No. 3,204,170, comprising essentially two elements of the same kind consisting of strip-iron, angle-iron or the like welded substantially at each end of the operator. When installing devices of this type they must necessarily be brought to the site, supported and held in their final fixing position, and then secured by means of screws, bolts or the like to the structure by which they are to be supported. Now this procedure requires that at least one person be placed at each end of the device and provided with hoisting means for bringing and supporting the device and eventually installing it in position, these means consisting either of supporting and lifting the structure, such as jacks, adjustable scaffoldings for supporting and holding the device, and at least another person for actually performing the installation.

The second family comprises considerably improved devices such as disclosed in the following patents: U.S. Pat. No. 3,220,718, U.S. Pat. No. 4,018,005, U.S. Pat. No. 4,231,191, U.S. Pat. No. 4,311,225, FR No. 2 493 451 and DE No. 29 04 718. In these prior art devices one of the two fixing elements located substantially at each end of the device consists of a joint or hinge connection. When installing an device provided with a device of this type it is possible, due to the provision of the joint coupling, to install the hinged end in a first step, and then fix the other end in a second step. This procedure requires at least one person provided with hoisting means for bringing and holding the hinged end in position, and installing this end by means of a pin or the like, and at least another person for supporting and guiding the other end which otherwise would slide on the floor, and thus damage the relatively fragile component elements of the motor and reduction gear unit enclosed in a case at this other end of the structure, or hoisting means for bringing and holding the operator substantially in its final position and at least another person for fixing the operator.

As a rule, hitherto known devices are therefore such that a single, unaided fitter, who does not have at his disposal any extra manpower or special equipment, cannot bring and install the device in position without seriously jeopardizing the device and the installer's safety. On the other hand, all known devices require the use of additional elements such as screws, pins or the like which must be set in position while the structure is still supported by the installer, thus increasing the difficulties and the risks.

SUMMARY OF THE INVENTION

It is the primary object of the present invention to permit the installation of a structure for actuating a tip-up or sectional door, as defined hereinabove, by a single person, by using conventional tools and without resorting to ancillary means, and without risk of property damage or bodily injury.

For this purpose the device for actuating a tip-up or sectional door according to the present invention is characterised in that the means for installing the frame structure at one end thereof consist on the one hand of a fixed support independent of the frame structure and having at least one contoured support and a portion overlying said contoured support at a predetermined vertical distance therefrom, and on the other hand, at the opposite end of the frame structure, a contoured support surface cooperating with said at least one contoured support of said fixed support and having a contour matching at least substantially the contour of said fixed support, and, overlying said contoured support surface, a locking surface facing upwards and disposed at an overall distance from said contoured support surface which is equal to the distance between said contoured support and the portion overlying said contoured support, whereby said frame structure can be firstly anchored vertically or obliquely in said fixed support through its contoured support surface and subsequently raised by pivoting on said contoured support of said fixed support so as to be installed at its other or second fixing point, said locking surface of the frame engaging from beneath said portion of said fixed support and thus preventing said frame support surface from being released from the frame bearing.

The linear actuating device according to the present invention can easily be installed by a single person, without any danger. In fact, the installer can easily cause the frame end provided with the bearing support surface to engage the contoured support of the fixed of the support. Thus, this frame end is anchored and the installer can easily lift the opposite end of the frame without taking care of the first end which will be locked automatically in the support.

THE DRAWINGS

FIG. 1 is a part-sectional, part-elevational side view of a linear actuator according to a first form of embodiment of the invention.

FIG. 2 is a section taken along the line II—II of FIG. 1, showing only the tubular frame of the device, FIG. 3 is a partial plane view of the device of FIG. 1, FIG. 4 is a partial view of a second form of embodiment in which the fixed spring is shown in section taken along the line IV—IV of FIG. 5, and FIG. 5 is a partial top view of the device of FIG. 4.

DESCRIPTION OF THE PREFERRED EMBODIMENTS

The structure shown diagrammatically and partially in FIGS. 1–3 of the drawings comprises a linear actuator 1 consisting of a tubular frame 2 of rectangular cross-sectional configuration in which a motor and reduction gear unit 3 shown only diagrammatically is fitted, this unit 3 driving a worm screw 4 engaged in a nut 5 rigidly coupled to a vertical depending arm 6 extending through an axial slot 7 formed in the bottom wall of the frame 2, said arm being coupled to a rod (not shown) connected to the tip-up or sectional door to be controlled, notably a vertically movable garage door. This linear actuator is secured on the one hand to a vertical wall 8 of the garage, for instance above the door, to the ceiling 18, by means of an I-sectioned suspension member 11 having its minor base 12 slidably engaged in the upper portion 13 of the rectangular-sectioned frame structure 2. For this purpose, the top wall of frame member 2 has a longitudinal slot 14 formed along one portion of its length to permit the insertion of the I-section member 11.

The support 9 consists of a U-shaped member of which the two vertical arms 9*a*, 9*b* constitute a double bracket. This support 9 is secured to the wall by means of screws 15 and 16. Each arm 9*a*, 9*b* is provided with a lateral notch of which the lower portion comprises a semi-circular groove 17, the upper edge 18 of this notch having an arcuate configuration concentric to the groove 17. On the other hand the corresponding end of the frame 2 is provided with a pair of transverse parallel pins 19, 20 projecting laterally from the frame 2, the overall distance (i.e. the distance between the outermost portions of the pins 19, 20) being equal or at least substantially equal, to the distance between the bottom of groove 17 and the arcuate edge 18 of support 9.

The groove 17 acts as a bearing stop to the support surface integral with the frame 2, which consists of each end of pin 19. The other pin 20 acts as a locking surface by cooperating with the arcuate edge 18 of the support and abutting this edge in case an attempt were made to raise the end of frame 2 for releasing same from the groove 17.

For fitting the device in position firstly the pin 19 of the frame 2 is engaged into the notches of support 9 by holding the frame vertically or obliquely. The ends of pin 19, which are guided by the oblique bottoms 27 of said notches, will thus engage automatically the grooves 17 in which they are retained as illustrated in dash and dot lines at 2'. Then, the installer has only to raise the other end of the frame 2 by using the pin 19 as a pivot. During this movement the pin 20 carried by the frame engages the edges 20 of the notches formed in the U-shaped support 9, thus locking this end of the frame. The installer can thus disregard this end and concentrate on the installation of the suspension member 11.

In the second form of embodiment shown in FIGS. 4 and 5, a pair of horizontal, cylindrical and parallel pins 21, 22 interconnecting the wings 9*a* and 9*b* are substituted for the notches of the first form of embodiment, and a pair of parallel arms 23, 24 parallel to, and disposed between, said wings 9*a* and 9*b*, are substituted for the pins 19 and 20 of frame structure 2. Each arm 23, 24 has formed on its lower edge a semicircular groove 25 of same radius as the pin 22 and an arcuate upper edge 26 concentric to the pin 22. The vertical distance between the bottom of groove 25 and the circular arc 26 is equal to the distance between the pins 21 and 22. The pin acts as a support for the groove 25, and the pin 21 provides a locking surface for the arcuate edges 26 of arms 23 and 24.

The device according to this second form of embodiment is implemented as in the case of the first form of embodiment. The frame 2 is held in a very inclined position and the arms 23, 24 are caused to bear on the pin 22 of support 9 so that the grooves 25 engage this pin 22. Then, by utilizing this pin 22 as a support and pivot point, the other end of frame 2 is rasied. During this pivoting movement, the upper edges 26 of arms 23, 24 engage the pin 21 from beneath, thus locking the device. The second point for installing the frame 2 is obtained as illustrated in FIGS. and 2.

The mode of installation of the present invention lends itself to many modifications within the scope of the invention. Thus, more particularly, the notches formed in support 9, in the first form of embodiment, may have any other suitable configuration, for example a simply rectangular configuration. The grooves and pins are not necessarily of circular cross-section.

According to a modified construction of the first form of embodiment, a single vertical profile for example in the form of ribs having rounded or plain ends, may be substituted for the pins 19 and 20. The upper edges of the notches formed in said support, whether or arcuate or straight configuration, may if desired be lined with a resilient material to be compressed by the pin 20. In this case the distance between the bottom of groove 17 and the resilient surface would be smaller than the overall distance between pins 19 and 20, before the device is fitted in its operative position, but these distances will be exactly equal when the device is in its opposite position.

I claim:

1. Apparatus for actuating a tip-up or sectional door, which comprises a linear actuator engaging an elongated frame structure and means for securing this frame structure at two upper points, at least one of said points being located at one end of the frame structure, wherein said means for securing the frame structure which is located at one end of the frame structure comprises a fixed support independent of the frame structure, said fixed support comprising at least one contoured support and a portion overlying said contoured support at a predetermined vertical disclosure therefrom, and at an end of said frame structure a frame surface shaped to engage said contoured support of said fixed support and having a contour substantially matching the contour of said contoured support of said fixed support and, overlying said frame support surface, a locking surface facing upwards at a distance from said frame support surface of said frame equal to the distance between said contoured support and said portion of said fixture, whereby said frame structure is supported in a vertical or oblique position by means of said contoured frame support surface engaging said contoured support, and said frame support pivots in said contoured support as said frame structure is raised from said vertical or oblique position to engage one of said upper points, said locking surface of said frame structure engaging, from beneath, said portion of said fixed support to prevent the contoured frame support surface from being released from said fixed support.

2. Apparatus for actuating a tip-up or sectional door, which comprises a linear actuator engaging an elongated frame structure and means for securing this frame structure at two upper points, at least one of said points being located at one end of the frame structure, wherein said means for securing the frame structure which is located at one end of the frame structure comprises a fixed support independent of the frame structure, said fixed support comprising at least one contoured support and a portion overlying said contoured support at a predetermined vertical disclosure therefrom, and at an end of said frame structure a frame support surface shaped to with engage said contoured support of said fixed support and having a contour substantially matching the contour of said contoured support of said fixed support and, overlying said frame support surface, a locking surface facing upwards at a distance from said frame support surface of said frame equal to the distance between said contoured support and said portion of said fixture, whereby said frame structure is supported in a vertical or oblique position by means of said contoured frame support surface engaging said contoured support, and said frame support position said contoured support as said frame structure is raised from said vertical or oblique position to engage one of said upper points, said locking surface of said frame structure engaging, from beneath, said portion of said fixed support to prevent the contoured frame support surface from being released from said fixed support where said contoured support comprises a horizontal groove formed in a vertical notch of said fixed support, said portion overlying said contoured support comprising an upper portion of said fixed support limited by an upper portion of said notch, said support comprising a first horizontal pin and said locking surface comprising a second pin parallel to said first pin.

3. The apparatus of claim 2, wherein said groove has a semi-circular configuration, said pins are cylindrical and an upper edge of said notch has a circular configuration concentric to the curvature of said groove.

4. Apparatus for actuating a tip-up or sectional door, which comprises a linear actuator engaging an elongated frame structure and means for securing this frame structure at two upper points, at least one of said points being located at one end of the frame structure, wherein said means for securing the frame structure which is located at one end of the frame structure comprises a fixed support independent of the frame structure, said fixed support comprising at least one contoured support and a portion overlying said contoured support at a predetermined vertical disclosure therefrom, and at an end of said frame structure a frame support surface shaped to with engage said contoured support of said fixed support and having a contour substantially matching the contour of said frame support of said fixed support and, overlying said frame support surface, a locking surface facing upwards at a distance from said contoured support surface of said frame equal to the distance between said contoured support and of said fixture said portion, whereby said frame structure is supported in a vertical or oblique position by means of said contoured frame support surface engaging said contoured support and said frame support pivots in said contoured support as said frame structure is raised from said vertical or oblique position to engage one of said upper points, said locking surface structure engaging, from beneath, said portion of said fixed support to prevent the contoured frame support surface of the frame from being released from said fixed support, wherein said contoured support comprises a first horizontal pin, said portion overlaying said contoured support comprising a second pin parallel and vertically adjacent to said first pin, said contoured support surface comprising a groove formed in a lower edge of at least one arm rigidly connected to said frame structure, an upper edge of said arm comprising said locking surface.

5. The apparatus of claim 4, wherein said pins are cylindrical, said groove is semi-circular and the upper edge of said arm is arcuated and concentric to said groove.

* * * * *